US006422159B1

(12) United States Patent
Hunter

(10) Patent No.: US 6,422,159 B1
(45) Date of Patent: Jul. 23, 2002

(54) INCINERATOR FOR HOME USE

(76) Inventor: W. C. Hunter, 4303 Pattentown Rd., Ooltewah, TN (US) 37363

( * ) Notice: Subject to any disclaimer, the term of this patent is extended or adjusted under 35 U.S.C. 154(b) by 0 days.

(21) Appl. No.: 09/855,133

(22) Filed: May 14, 2001

(51) Int. Cl.[7] ..... F23B 5/00; F23G 7/06; F23G 5/44; F23J 15/00; F23J 1/00

(52) U.S. Cl. ..... 110/214; 110/211; 110/203; 110/216; 110/235; 110/165 R; 110/182.5

(58) Field of Search ..... 110/203, 210, 110/211, 212, 213, 214, 216, 235, 346, 342, 344, 165 R, 182.5

(56) References Cited

U.S. PATENT DOCUMENTS

| | | | | | |
|---|---|---|---|---|---|
| 2,929,342 | A | * | 3/1960 | Young | 110/8 |
| 2,962,987 | A | * | 12/1960 | Hebert et al. | 110/8 |
| 3,043,245 | A | * | 7/1962 | Hebert et al. | 110/8 |
| 3,043,247 | A | * | 7/1962 | Hebert et al. | 110/8 |
| 3,051,100 | A | * | 8/1962 | Singleton | 110/8 |
| 3,068,812 | A | * | 12/1962 | Hemeon | 110/8 |
| 3,082,714 | A | * | 3/1963 | Close | 110/8 |
| 3,089,440 | A | * | 5/1963 | Morgan | 110/18 |
| 3,150,619 | A | * | 9/1964 | Brucken et al. | 110/8 |
| 3,195,608 | A | * | 7/1965 | Voorheis et al. | 158/5 |
| 3,364,887 | A | * | 1/1968 | Bourner | 110/8 |
| 3,509,834 | A | * | 5/1970 | Rosenberg et al. | 110/8 |
| 3,566,809 | A | * | 3/1971 | Carry | 110/8 |
| 3,776,148 | A | * | 12/1973 | Hapgood | 110/8 A |
| 4,027,602 | A | * | 6/1977 | Mott | 110/7 R |
| 4,334,484 | A | * | 6/1982 | Payne et al. | 110/210 |
| 5,050,512 | A | * | 9/1991 | Tratz et al. | 110/346 |
| 5,323,714 | A | * | 6/1994 | Cox | 110/229 |
| 5,579,704 | A | * | 12/1996 | Mansur | 110/185 |
| 6,305,302 | B2 | * | 10/2001 | Kleiss | 110/210 |

* cited by examiner

*Primary Examiner*—Ira S. Lazarus
*Assistant Examiner*—K. B. Rinehart
(74) *Attorney, Agent, or Firm*—John L. James

(57) ABSTRACT

An incinerator has a combustion vessel, a base trap and an afterburner. The combustion vessel has a combustion chamber, an exhaust leading from the chamber, an air intake leading to the chamber, and a gas intake leading to the chamber. Fresh air is mixed with burning propane gas to elevate the temperature to incinerate waste with little ash. Household waste burns in the chamber generating flue gas that is moved from the chamber to the base trap where it is cooled. The cooled flue gas is moved from the base trap through a filter to the afterburner where it is oxygenated and burned prior to release to the atmosphere.

5 Claims, 3 Drawing Sheets

INCINERATOR FOR HOME USE

FIELD OF THE INVENTION

The present invention relates generally to an incinerator, and, more particularly, to a refuse incinerator for home use for burning most household wastes.

BACKGROUND OF THE INVENTION

Incinerators for home use were once very popular with thousands of units manufactured each year. In 1993 during an energy conservation movement, the use of gas for incineration was effectively banned thereby halting the manufacture of home incinerators. When the ban was lifted, manufacturing did not resume. A gas incinerator for home use required a masonry chimney which meant that in addition to the purchase of an incinerator unit, skilled tradesmen had to be employed for the installation. A problem with conventional incinerators was that the metal stove pipe connecting the incinerator to the masonry chimney became very hot during use often glowing red thereby posing a hazard. These incinerators would not burn magazines or similar articles and created considerable ash which had to be shoveled out by hand. It is desirable to have an outdoor home incinerator to burn combustible home waste materials that would otherwise find their way to a landfill.

SUMMARY OF THE INVENTION

Briefly summarized, according to one aspect of the present invention, an incinerator, comprises a combustion vessel having a chamber, an exhaust leading from the chamber, an air intake leading to the chamber, and a gas intake leading to the chamber. The incinerator has a base trap, means for moving flue gas from the chamber to the base trap, and means for cooling flue gas in the base trap. The incinerator has an afterburner, means for moving cooled flue gas to the afterburner, and a filter interposed between the base trap and the afterburner for removing any particulate from the cooled flue gas.

The incinerator mixes fresh air with burning propane gas to amplify the heat generated by the flames for high temperature burning in short periods of time. At the same time, a flue gas transport system cools down the flue gas and moves it into an afterburner for mixing with fresh air and final burning to produce harmless carbon dioxide and water vapor. The incinerator does not require a chimney, emits no smoke and stores the small amount of solid residue in a small ash tray. Once started, operation is automatic requiring no attention from an operator.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
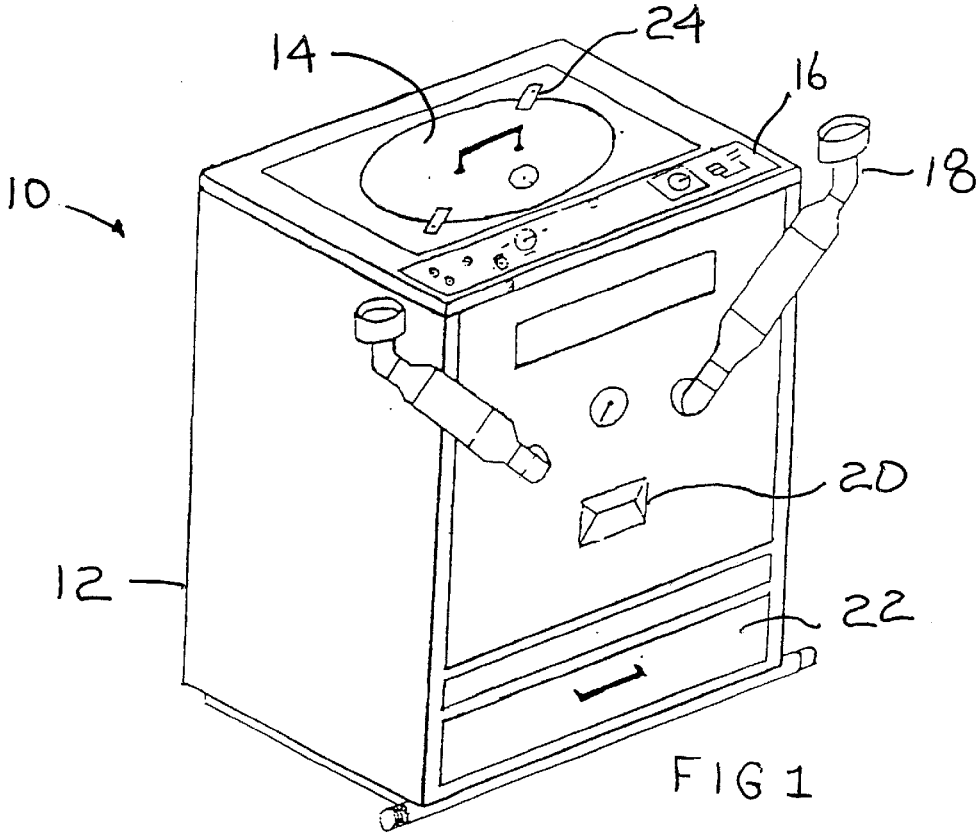
FIG. 1 is diagrammatic perspective view of a preferred embodiment of an incinerator for home use according to the present invention.
Figure 2:
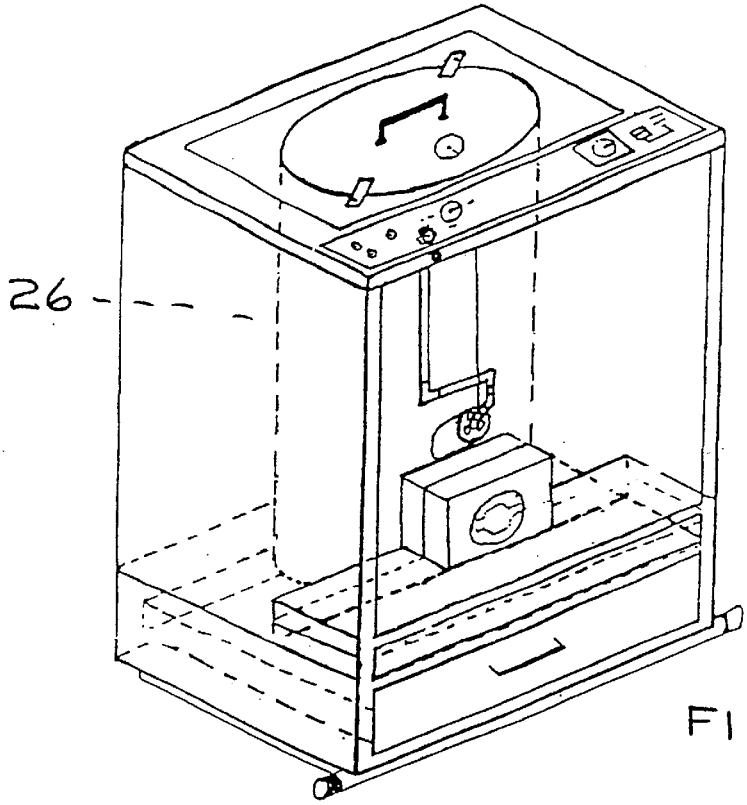
FIG. 2 is a perspective view similar to FIG. 1 but showing some internal components in broken lines.
Figure 3:
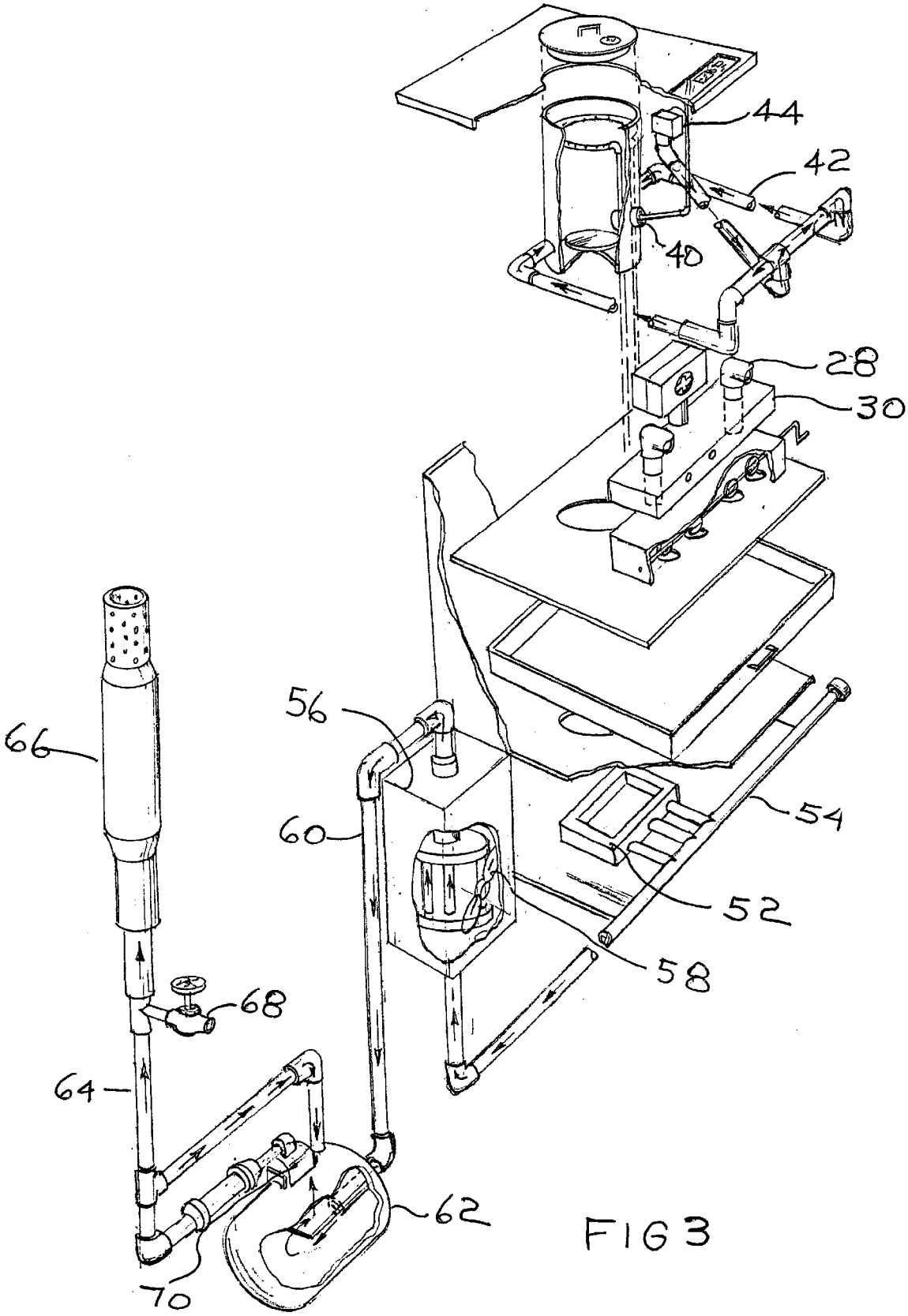
FIG. 3 is an exploded diagrammatic view of the incinerator of FIG. 1.
Figure 4:
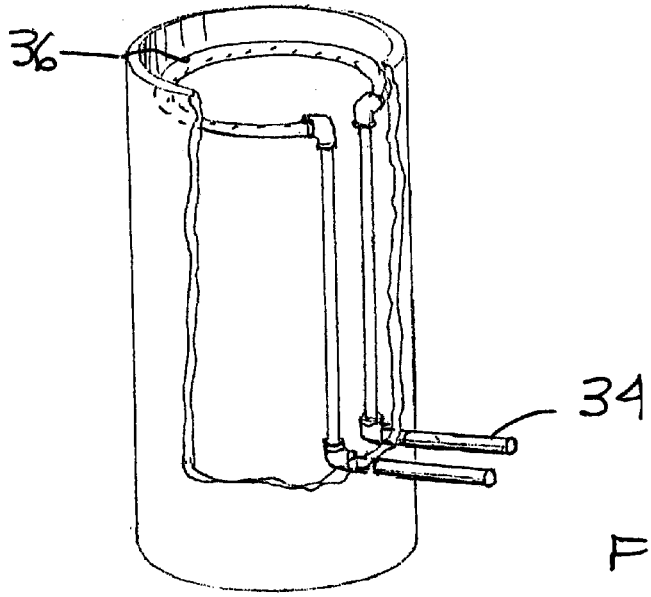
FIG. 4 illustrates the combustion chamber for the incinerator.
Figure 5:
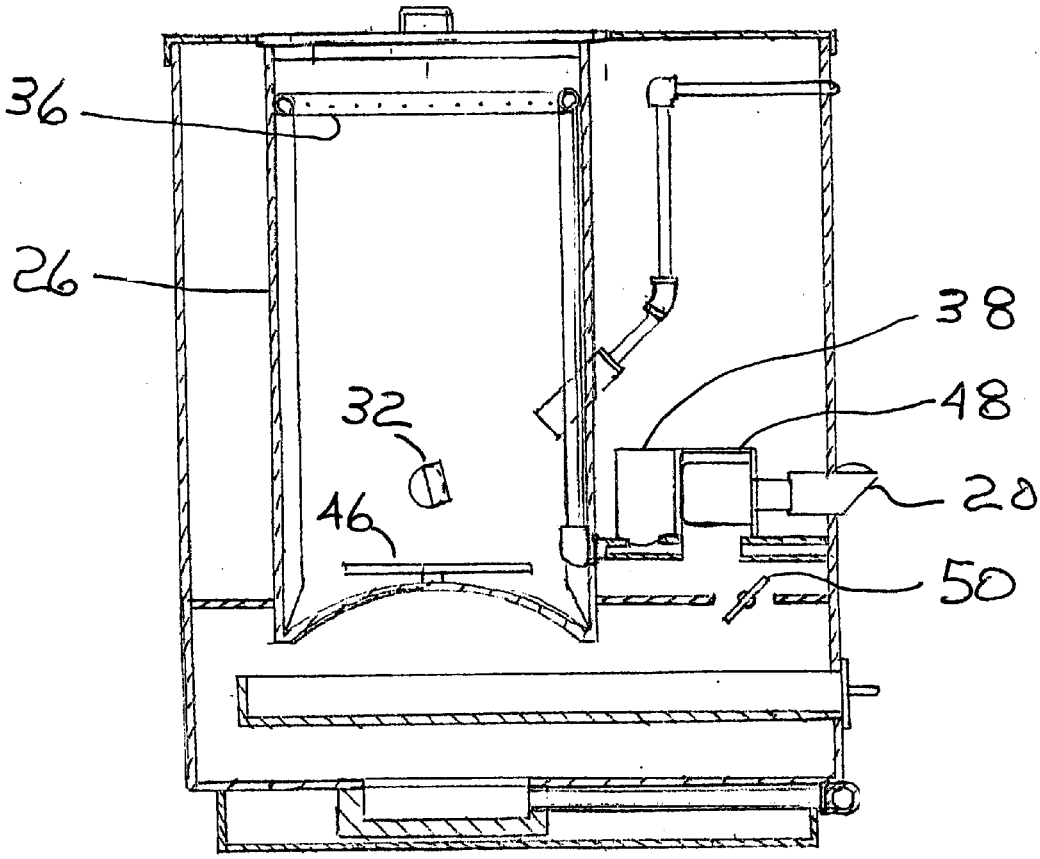
FIG. 5 is a diagrammatic side view with a longitudinal section of the combustion vessel removed.

Referring to FIG. 1, an incinerator 10 for outdoor home use has a housing 12 constructed of metal resistant to deterioration from exposure to the elements, such as porcelain on steel or rust resistant steel, for example. Waste material to be burned is inserted in the unit through a lid 14 at the top of the unit. Also positioned at the top of the unit is a control panel 16 with controls for regulating gas and air flow. At the front of the unit are air inlets 18, a fresh air port 20 and access to an ashtray 22. The incinerator receives refuse through lid 14 which is locked in position with clamps 24 during combustion. The unit is compact in size approximating the dimensions of an automatic washing machine.

Referring to FIGS. 1–5, the incinerator 10 has a combustion vessel 26 that is preferably cylindrical in configuration defining a combustion chamber within its sidewalls. Combustion vessel 26 is open at its top end which is closed during combustion by the lid 14. The vessel is also constructed of a heat and corrosion resistant material such as cast iron, tungsten steel or other material suitable for furnace use.

Air flows from air inlets 18 through air inlet ducts 28 to air regulator 30 and through air flow guides 32 which enter the combustion vessel 26 through its sidewall. Several air flow guide 32 spaced about the inside of the combustion vessel cause the input air to swirl or whirlwind in the combustion vessel. Swirling effectively mixes the input air and fuel gas in the combustion chamber so that there is complete combustion. The swirling also helps push ash to the ash tray 22.

Air regulator 30 preferably includes an electric fan that draws air into the air inlets 18 and exhausts it into the air flow guides 32 at a higher speed. The speed is sufficient to create an air swirl in the combustion chamber. Preferably, the fan is a variable speed fan whose speed varies automatically with temperature inside the combustion chamber. The forced air in a whirlwind pattern mixes air and burning gases to achieve higher burning temperatures in shorter periods of time than merely introducing extra combustion air.

Exhaust pipes 34 enter near the bottom of the vessel and bend 90 degrees to extend toward the top of the vessel. The two exhaust pipes 34 are connected by an arcuate perforated pipe 36 which is nearly circular in configuration. The perforations exist on the bottom side of pipe 36 and serve to suction out ash and products of combustion. Pipes 34 enter a dual exhaust engine 38 which includes a fan 48. The fan 48 creates suction in exhaust pipes 34 and perforated pipe 36 to draw in combustion gases and ash. As the fan operates, fresh air is drawn in through fresh air port 20 to cool internal wiring and components.

Control panel 16 has attached to it an igniter 40 and fuel lines 42 which enter the combustion chamber through the sidewall. A gas regulator 44 regulates the flow of fuel gas, which is preferably propane, while a timer on the control panel determines the length of time the fuel flows. Switches on the control panel turn the power on, start the igniter and start fuel gas flowing to begin the incineration process. Gas shut off is automatic when the timer is set.

A base plate 46 in the combustion chamber receives the refuse to be burned. As the refuse burns, ash is forced into ash tray 22. Ash, along with gaseous products of combustion, exits through perforated pipe 36 and enters a mixing chamber where it mixes with fresh air from air regulator 30. The mixing cools the exhausted air to prevent damage to wiring or other components. Exhaust air flow is regulated by a damper 50 in the bottom of the mixing chamber. The heavier ash is deposited in ash tray 22 while the lighter combustion gas and fresh air mixture is drawn into base trap 52 and exhausted through exhaust pipe 54.

A cool down unit 56 reduces the temperature of the exhaust gas in pipe 54. The cool down unit 56 incorporates a fan 58 to blow air over radiator type pipes that divide the flow from exhaust pipe 54 into several pipes or coils to receive air from fan 58 and then recombine the flow into a single, cooled exhaust 60.

A filter 62 receives the exhaust from pipe 60 and separates tar, debris and other solids from the exhaust gas. Filtered exhaust gas is routed via pipe 64 to an afterburner 66. Afterburner 66 has a gas inlet 68 which inputs fuel gas to mix with he exhaust gas to form a combustible mixture to completely burn the exhaust gas. Afterburner 66 also has inlets for air so the propane fuel gas and exhaust gas mixture will burn completely. Because filter 62 removes all solids, the exhaust gas contains only hydrocarbons which burn completely when mixed with propane and air.

A primary exhaust engine 70 creates suction in exhaust pipe 54 to draw in the combustion gas and fresh air mixture when the darner 50 is open.

Operation of the present invention is beleived to be apparent from the foregoing description and drawings, but a few words will be added for emphasis. Loosening the clamps 24 holding lid 14 reveals the combustion chamber where household debris is placed to be incinerated. When the combustion chamber is full or burning is desired, the lid is secured in position with the clamps. The controls on control panel 16 are set including the timer which determines the length of the burning cycle. Fuel gas flows into the combustion chamber through gas lines 42 and is ejected through the vessel sidewall into the combustion chamber. Fresh air from air inlets 18 enter the air flow regulator 30 and flows to the combustion chamber through air flow guides 32. The fuel gas and air mixture is lighted by ignitor 40. As the temperature in the vessel rises, a variable speed fan in regulator 30 increases air flow through the guides 32 creating a whirlwind further increasing the temperature and burning the debris. Ash that would normally collect on base plate 44 in the bottom of the vessel is blown off the base plate by the whirlwind.

Combustion gases and scattered ash are suctioned into exhaust pipe 36 by fan 48 in dual exhaust engine 38. The exhaust gas is mixed with fresh air drawn in through air vent 20 by fan 48 which cools the exhaust to protect wiring and other components. Damper 50 regulates the flow of the exhaust. Ash precipitates out of the exhaust and is collected in bottom ash tray 22 while gases are drawn into the bottom base trap 52. Suction to move gases from base trap 52 is provided by exhaust engine 70 through exhaust pipe 54.

Exhaust gases are cooled in cooler 56 with the aid of fan 58 before entering filter 62 where solids are filtered out of the exhaust. Afterburner 66 mixes fuel gas and fresh air with the filtered exhaust and completely burns the mixture.

While the invention has been described with particular reference to the preferred embodiments, it will be understood by those skilled in the art that various changes may be made and equivalents may be substituted for elements of the preferred embodiments without departing from invention. Also, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. An incinerator, comprising:

a combustion vessel having a chamber, an exhaust opening leading from said chamber, an air intake leading into said chamber, and a gas intake leading into said chamber;

a base trap;

means for moving combustion gases from said chamber to said base trap;

means for cooling combustion gases;

an afterburner having a fuel gas intake and a fresh air intake adapted so that fuel gas and fresh air mix with said combustion gases for complete burning of the combustion gases;

means for moving cooled combustion gases to said afterburner; and a filter interposed between said base trap and said afterburner for removing particulate matter from said cooled combustion gases.

2. An incinerator, as set forth in claim 1, including an air flow guide in said chamber attached about said air intake.

3. An incinerator, as set forth in claim 1, including a plurality of air flow guides attached to a sidewall of said vessel in communication with said air intake to direct intake air in a whirlwind pattern in said vessel.

4. An incinerator, as set forth in claim 1, including an ash tray positioned between said chamber and said base trap to receive ash from said chamber.

5. An incinerator, comprising:

a combustion vessel having a chamber, an exhaust opening leading from said chamber, an air intake leading into said chamber, and a gas intake leading into said chamber;

a base trap;

means for moving combustion gases from said chamber to said base trap;

means for cooling combustion gases;

an afterburner having a fuel gas intake and a fresh air intake adapted so that fuel gas and fresh air mix with said combustion gases for complete burning of the combustion gases;

means for moving cooled combustion gases to said afterburner;

a filter interposed between said base trap and said afterburner for removing particulate matter from said cooled combustion gases; and a damper positioned between said chamber and said base trap to receive and mix combustion solids and gases with fresh air received through a fresh air vent in a housing of said incinerator.

* * * * *